US005173639A

United States Patent [19]

Haraden

[11] Patent Number: 5,173,639

[45] Date of Patent: Dec. 22, 1992

[54] THERMAL SWITCH ASSEMBLY FOR ELECTRIC LAMPS

[75] Inventor: Thomas Haraden, Ipswich, Mass.

[73] Assignee: GTE Products Corporation, Danvers, Mass.

[21] Appl. No.: 634,464

[22] Filed: Dec. 27, 1990

[51] Int. Cl.[5] ..... H01J 61/00

[52] U.S. Cl. ..... 315/73; 313/601; 337/85

[58] Field of Search ..... 315/73, 60; 313/601; 337/36, 85, 88

[56] References Cited

U.S. PATENT DOCUMENTS

| | | | |
|---|---|---|---|
| 3,226,597 | 12/1965 | Green | 313/601 X |
| 3,619,710 | 11/1971 | Waymouth | 313/601 X |
| 3,753,019 | 8/1973 | Hellman | 313/601 X |
| 3,965,387 | 6/1976 | Stuart et al. | 315/60 X |
| 4,413,206 | 11/1983 | Karlotski et al. | 313/601 |
| 4,433,271 | 2/1984 | Inoue et al. | 313/601 X |
| 4,659,965 | 4/1987 | Bonazoli | 315/60 |
| 5,015,916 | 5/1991 | Mazza et al. . | |

*Primary Examiner*—Robert J. Pascal

*Attorney, Agent, or Firm*—Joseph S. Romanow

[57] ABSTRACT

A thermal switch assembly for use in electric lamps includes a bimetal element and a resilient conductor such as a tungsten wire. The conductor is mounted at an angle in the range of about 30° to 45° with respect to the plane of movement of the bimetal element and at an angle of about 90° with respect to the longitudinal axis of the bimetal element. The edge of the bimetal element contacts the conductor at a closure temperature and moves with a sliding action along the conductor as the temperature increases above the closure temperature. As a result, the switch contacts are self cleaning. Since the switch components are subjected to very little stress at elevated temperatures, the switch assembly has a long operating life. The bimetal element and the conductor can be affixed to a mounting frame which facilitates installation of the thermal switch assembly.

24 Claims, 3 Drawing Sheets

THERMAL SWITCH ASSEMBLY FOR ELECTRIC LAMPS

FIELD OF THE INVENTION

This invention relates to thermal switch assemblies for use in electric lamps and, more particularly, to bimetal switch assemblies having self-cleaning contacts and having a construction in which the switch components are not significantly stressed at high temperatures.

BACKGROUND OF THE INVENTION

Metal halide arc discharge lamps are widely used for general illumination. These lamps include an arc tube mounted within a light-transmissive lamp envelope. The lamp envelope may be evacuated or backfilled with nitrogen. The arc tube has electrodes sealed therein at opposite ends and contains a fill material including a starting gas, mercury and one or more metal halides. A starting electrode is commonly positioned at one end of the arc tube adjacent to one of the main electrodes to assist in starting. When the lamp is first turned on, a voltage is applied between the starting electrode and the adjacent main electrode. A discharge between the starting electrode and the adjacent main electrode heats the arc tube sufficiently to form a discharge between the main electrodes. After a discharge is formed between the main electrodes, the starting electrode is shorted to the adjacent main electrode by a thermal switch.

A thermal switch for metal halide lamps is disclosed in U.S. Pat. No. 3,965,387, issued Jun. 22, 1976 to Stuart et al. The disclosed thermal switch includes a bimetal element and a spring element attached to the bimetal element. At temperatures above the closure temperature, the spring is deformed, thereby relieving some of the stress which would otherwise be applied to the bimetal element.

A thermal switch for an arc discharge lamp is disclosed in U.S. Pat. No. 4,659,965, issued Apr. 21, 1987 to Bonazoli. The disclosed switch includes a bimetal strip attached to one electrode lead and a spring-like member attached to another electrode lead. The bimetal strip has a notch to receive the spring-like member when the closure temperature is reached.

While the prior art thermal switches provide generally satisfactory operation, they are subject to certain to practical problems. When temperature in the discharge lamp exceeds the closure temperature, the elements of the thermal switch are stressed and tend to become permanently deformed after multiple operations. When the switch elements are permanently deformed, the closure temperature of the switch changes and, in some cases, the thermal switch may fail to operate. Furthermore, it is frequently difficult to mount the elements of the thermal switch in the discharge lamp with sufficient precision to insure the desired operation. When the switch elements are displaced even slightly from their design positions, switch closure occurs at a temperature different from the desired closure temperature.

It is a general object of the present invention to provide improved thermal switch assemblies for use in electric lamps.

It is another object of the present invention to provide improved arc discharge lamps.

It is a further object of the present invention to provide improved thermal switch assemblies for controlling the application of electrical energy to a starting electrode in a metal halide arc discharge lamp.

It is yet another object of the present invention to provide a thermal switch assembly having a mounting frame to facilitate installation of the switch assembly.

It is a further object of the present invention to provide a thermal switch assembly which has a long operating life.

It is another object of the present invention to provide a thermal switch assembly wherein the switch elements are not significantly stressed during operation.

SUMMARY OF THE INVENTION

According to the present invention, these and other objects and advantages are achieved in an electric lamp comprising a light-transmissive lamp envelope, a light-emitting device mounted within the lamp envelope, means for conducting electrical energy to the light-emitting device, and a thermal switch assembly mounted within the lamp envelope for controlling application of electrical energy to the light-emitting device. The thermal switch assembly includes a bimetal element having a fixed portion and a movable portion, the movable portion being movable in a plane in response to temperature variations, and a resilient, elongated conductor having a longitudinal axis and being fixed at or near one end. The bimetal element and the conductor are mounted within the lamp envelope such that a first angle between a longitudinal axis of the conductor and the plane of movement of the bimetal element has a nonzero value, and a second angle between the longitudinal axis of the conductor and a longitudinal axis of the bimetal element has a nonzero value. The bimetal element contacts the conductor at a predetermined closure temperature.

In a preferred embodiment, the light-emitting device comprises an arc tube including first and second main electrodes and a starting electrode. The thermal switch assembly controls application of a voltage between first main electrode and the starting electrode during starting of the lamp.

The first angle between the longitudinal axis of the conductor and the plane of movement of the bimetal element is preferably in a range of about 30° to 45°. The second angle between the longitudinal axis of the conductor and the longitudinal axis of the bimetal element is preferably about 90°. The conductor is preferably a tungsten wire. The bimetal element preferably comprises an elongated bimetal strip having an edge that contacts the conductor at the closure temperature. The conductor is slightly deformed by the bimetal element at temperatures greater than the closure temperature. As the temperature increases above the closure temperature, the point of contact between the bimetal element and the conductor slides along the conductor, thereby providing self cleaning of the switch contacts.

In a preferred embodiment, the thermal switch assembly is mounted below the arc tube. The bimetal element is affixed to an electrical lead of the starting electrode, and the conductor is affixed to a frame member that is electrically connected to an electrical lead of the first main electrode.

According to another aspect of the invention, the thermal switch assembly further includes a mounting frame including a first frame part attached to a first conductive member in the lamp and a second frame part attached to a second conductive member in the lamp. The first and second frame parts of the mounting frame are joined by a removable frame part until installation of the thermal switch assembly in the arc discharge lamp. The bimetal element is affixed to the first frame part, and the conductor is affixed to the second frame part such that the mounting frame provides a desired positioning of the conductor relative to the bimetal element.

According to still another aspect of the invention there is provided a thermal switch assembly comprising a mounting frame including a first frame part and a second frame part that are joined by a removable frame part, a bimetal element attached to the first frame part, and a conductor attached to the second frame part. The mounting frame provides a desired positioning of the conductor relative to the bimetal element such that the bimetal element contacts the conductor at a predetermined closure temperature. The removable frame part of the mounting frame is removed after the first frame part is affixed to a first conductive member and the second frame part is affixed to a second conductive member.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
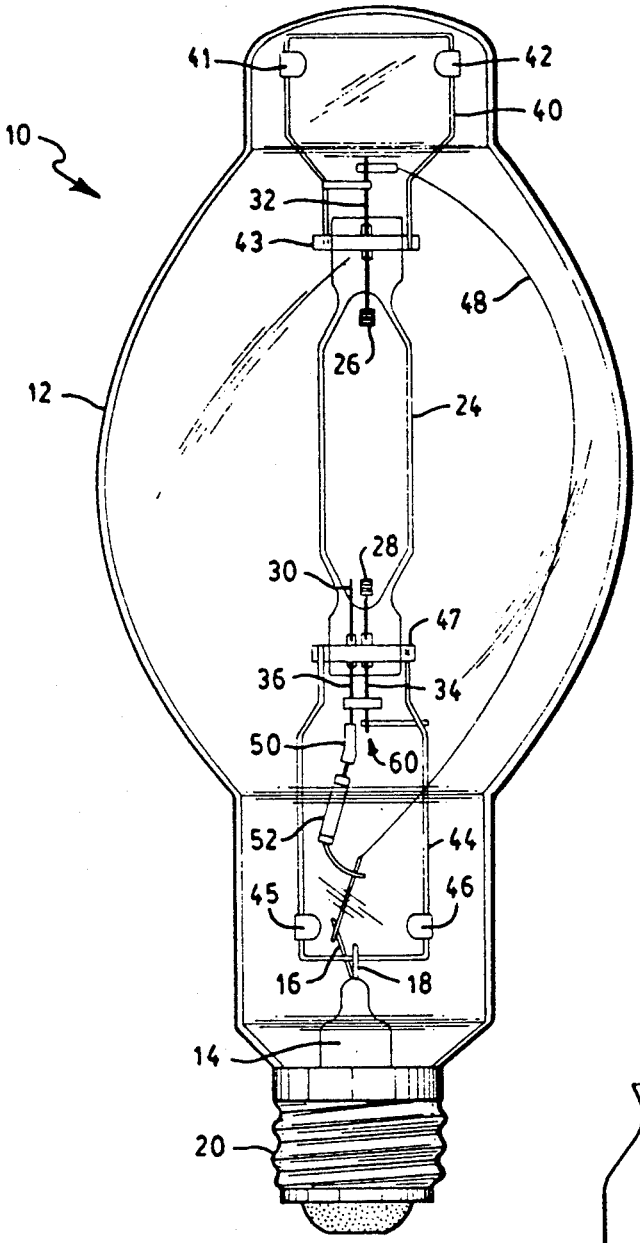
FIG. 1 is an elevational view of an arc discharge lamp that incorporates a thermal switch assembly in accordance with the present invention.

A metal halide arc discharge lamp 10 which incorporates a thermal switch assembly in accordance with the invention is shown in FIG. 1. A lamp envelope 12 is hermetially sealed to a lamp stem 14. Electrical inleads 16 and 18 are sealed into and pass through lamp stem 14 and are electrically connected to a base 20.

Mounted within the lamp envelope 12 is a quartz arc tube 24. The arc tube 24 has main electrodes 26 and 28 sealed into opposite ends thereof. Electrode leads 32 and 34 are electrically connected to electrodes 26 and 28, respectively. A starting electrode 30 is sealed into one end of the arc tube 24 and is positioned adjacent to main electrode 28. A starting electrode lead 36 is electrically connected to starting electrode 30. The electrical connections to electrodes 26, 28 and 30 are sealed into arc tube 24 using a press seal construction, as known in the art.

An upper frame member 40 is affixed to the upper end of arc tube 24 by means of a strap 43. The frame member 40 includes spring clips 41 and 42 which contact the lamp envelope 12 and support the arc tube 24 in the lamp envelope. A lower frame member 44 is affixed to the opposite end of arc tube 24 by means of a strap 47. The lower frame member 44 includes spring clips 45 and 46 which contact the lamp envelope 12 and support the arc tube 24 in the lamp envelope. A wire 48 is connected between electrode lead 32 and electrical inlead 16. Lower frame member 44 is attached to electrical inlead 18. Starting electrode lead 36 is connected by a nickel ribbon 50 and a resistor 52 to electrical inlead 16. Electrode lead 34 is connected by a nickel ribbon 54 to lower frame member 44.

Figure 2:
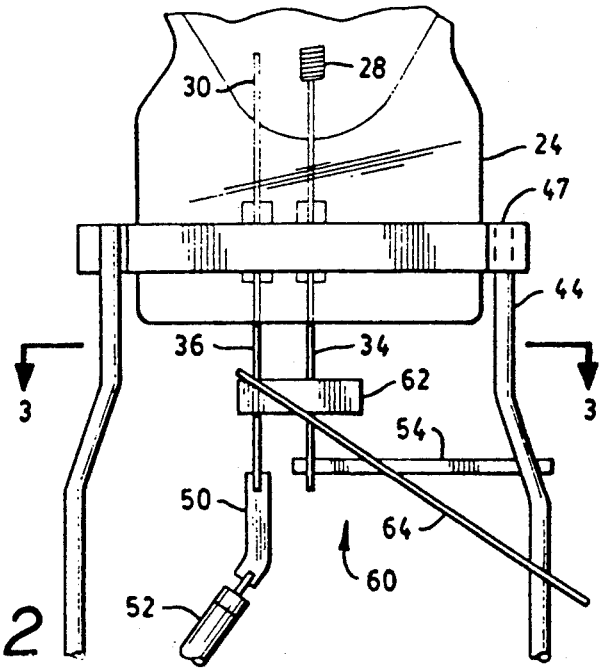
FIG. 2 is an enlarged, partial view of the lamp of FIG. 1, showing a first embodiment of the thermal switch assembly and the lower end of the arc tube.
Figure 3:
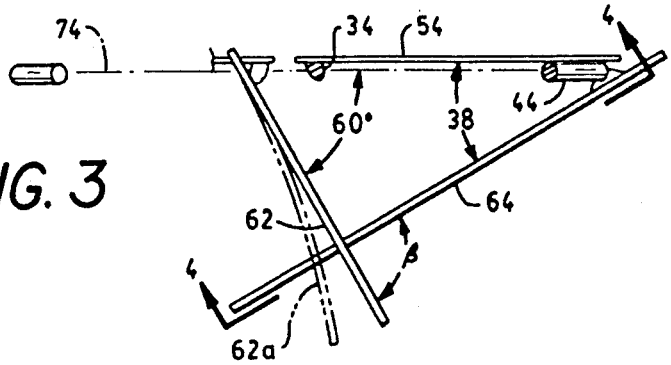
FIG. 3 is a cross-sectional view of the thermal switch assembly taken along the line 3—3 of FIG. 2.
Figure 4:
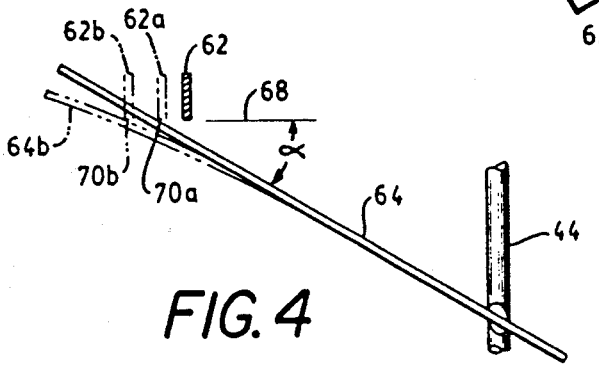
FIG. 4 is a cross-sectional view of the thermal switch assembly taken along the line 4—4 of FIG. 3.

A thermal switch assembly 60, shown in detail in FIGS. 2–4, is positioned below arc tube 24. The thermal switch assembly 60 includes a bimetal element 62 welded at or near one end to starting electrode lead 36 and a conductor 64 welded at or near one end to lower frame member 44. Since the lower frame member 44 is connected to electrode lead 34 by nickel ribbon 54, the thermal switch assembly 60 is effectively connected between main electrode 28 and starting electrode 30.

The contacts of the thermal switch assembly 60 are open when the lamp 10 is cold. When power is first applied to the lamp 10, a voltage is applied through resistor 52 to starting electrode 30 relative to main electrode 28 such that a discharge forms between starting electrode 30 and main electrode 28. When the arc tube 24 warms sufficiently, a discharge forms between main electrodes 26 and 28, and the temperature of arc tube 24 further increases. At a predetermined closure temperature, the contacts of the thermal switch assembly close, thereby electrically shorting starting electrode 30 to main electrode 28. The mechanical operation of the thermal switch assembly 60 is described below.

The construction and operation of the thermal switch assembly 60 are best shown in FIGS. 3 and 4. The bimetal element 62 is welded at or near one end to starting electrode lead 36 and comprises a conventional bimetal strip such as an ASTM type TM5. In one example of the thermal switch assembly, the bimetal strip 62 has a length of about 0.875-inch, and a width of about 0.125-inch. The position of bimetal strip 62 at room temperature is shown with solid lines in FIGS. 3 and 4. As the temperature in the region of thermal switch assembly 60 increases, the bimetal strip 62 deforms to successive positions 62*a* and 62*b* shown in phantom in FIGS. 3 and 4. It can be seen from FIG. 4 that the deformation of bimetal strip 62 at elevated temperatures causes movement of the bimetal element 62 in a plane 68.

The conductor 64 is attached to lower frame member 44 so that conductor 64 is oriented at an angle $\alpha$ with respect to plane 68. In the embodiment of FIGS. 2–4 the angle $\alpha$ between conductor 64 and plane 68 is about 30°. The conductor 64 preferably comprises a tungsten wire. In one example of the thermal switch assembly, the tungsten wire has a diameter of about 0.015-inch and a length of about 1.5-inches. The wire material used for conductor 64 must be resistant to both heat and to being welded to the bimetal strip during hot restrike conditions. Hot restrike occurs after a short power outtage. The lamp extinguishes upon loss of power and starts to cool. If power returns before the bimetal switch opens, an arc is created between the bimetal element and the conductor as they open. Some materials weld together under these conditions. Tungsten is a suitable material to avoid such welding.

The conductor 64 is positioned so that bimetal element 62 and conductor 64 are spaced apart at room temperature. As best shown in FIG. 3, the bimetal element 62 and the conductor 64 are attached to the respective support elements so that an angle $\beta$ between the longitudinal axis of conductor 64 and the longitudinal axis of bimetal element 62 at room temperature is approximately 90°. As shown in FIG. 3, the axis of bimetal element 62 is mounted at an angle of about 60° with respect to a plane 74 defined by lower frame member 44 and electrode leads 34 and 36. The conductor 64 is mounted at an angle of about 30° with respect to the plane 74.

As the temperature within the lamp envelope 12 increases, the bimetal element 62 deforms and at a predetermined closure temperature of approximately 250° C.–300° C. contacts conductor 64 as shown in phantom at 62*a* in FIGS. 3 and 4. The point of contact is between an edge of bimetal strip 62 and the tungsten wire of conductor 64. As the temperature within lamp envelope 12 increases above the closure temperature, the bimetal element 62 further deforms to a position as shown in phantom at 62*b* in FIG. 4. The conductor 64 is slightly deformed at the elevated temperature, as shown in phantom at 64*b* in FIG. 4.

The thermal switch assembly 60 shown and described herein provides several improvements in comparison with prior art thermal switches. There is very little stress in the bimetal strip 62 or the conductor 64, even at elevated temperatures. The conductor 64 is deformed somewhat at elevated temperatures, but with very little stress applied to the bimetal element 62. As a result, the bimetal element 62 does not tend to permanently deform over the operating life of the lamp. Furthermore, as shown in FIG. 4, the contact point between bimetal element 62 and conductor 64 moves with a sliding action from position 70*a* to position 70*b* at elevated temperatures, thereby producing a self cleaning contact design.

Figure 5:
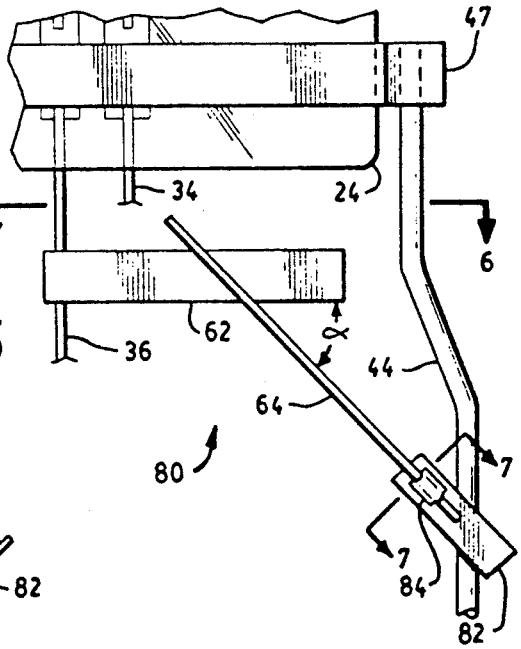
FIG. 5 is an enlarged, partial view of the lamp showing an alternate construction of the thermal switch assembly.
Figure 6:
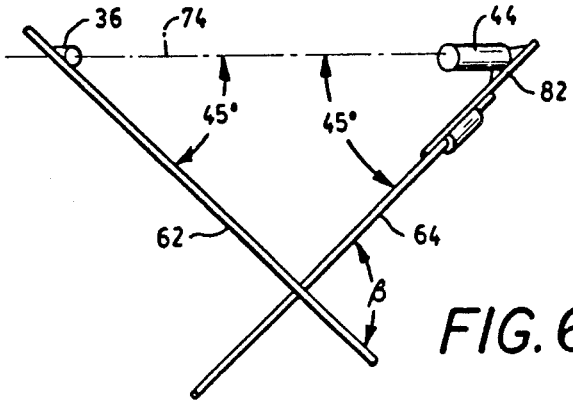
FIG. 6 is a cross-sectional view of the alternate thermal switch assembly taken along the line 6—6 of FIG. 5.
Figure 7:
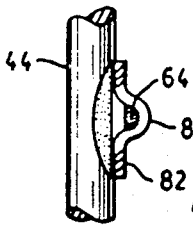
FIG. 7 is an enlarged cross-sectional view of the tungsten wire and wire holder taken along the line 7—7 of FIG. 5.

Alternates of the thermal switch assembly shown in FIGS. 2–4 and described hereinabove are illustrated in FIGS. 5–7. A thermal switch assembly 80 is similar to the thermal switch 60 of FIG. 2, except that the angle $\alpha$ between conductor 64 and the plane 68 of movement of bimetal element 62 is about 45°, and a wire holder 82 is included in the thermal switch assembly 80. The wire holder 82 is welded to lower frame member 44 and includes a strap 84 for retaining the conductor 64. The angle between the axis of bimetal element 62 and the plane 74 of lower frame member 44 is about 45°. The angle between conductor 64 and the plane 74 is also about 45°. As a result, the longitudinal axis of bimetal element 62 at room temperature is oriented at an angle $\beta$ of about 90° with respect to the longitudinal axis of conductor 64. In general, the angle $\alpha$ between conductor 64 and the plane 68 of movement of bimetal element 62 is preferably in a range of about 30° to 45°. The angle $\beta$ between the longitudinal axis of bimetal element 62 and conductor 64 at room temperature is preferably in a range of about 80° to 100°.

The bimetal strip 62 must be attached to starting electrode lead 36 and the conductor 64 or holder 82 must be attached to lower frame member 44 with reasonable precision to insure proper operation of the thermal switch assembly. If either element of the switch assembly is displaced from its required position, the thermal switch will close at a temperature above or below the desired closure temperature.

Figure 8:
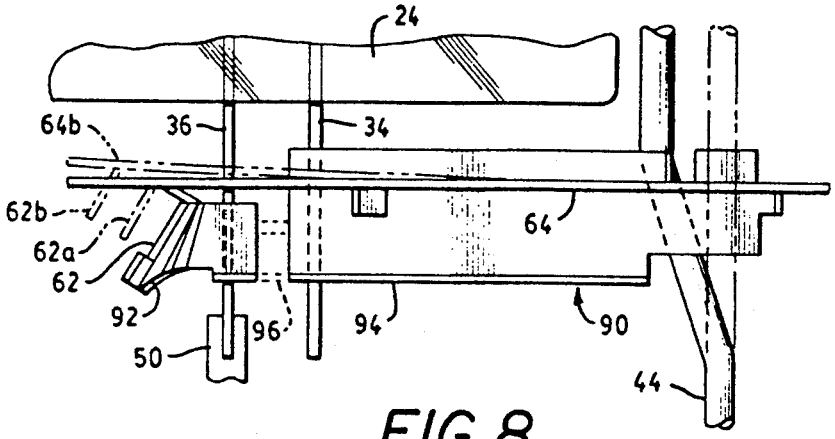
FIG. 8 is an enlarged, partial view of the lamp showing a second embodiment of the thermal switch assembly.
Figure 9:
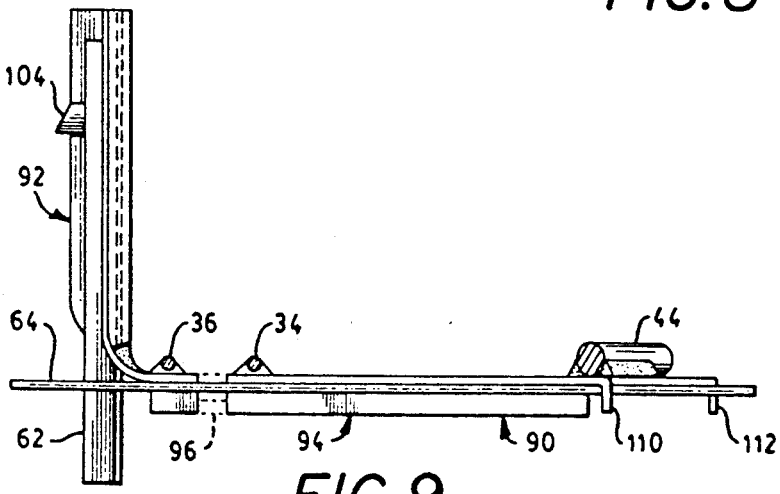
FIG. 9 is a cross-sectional view of the second embodiment taken along the line 9—9 of FIG. 8.
Figure 10:
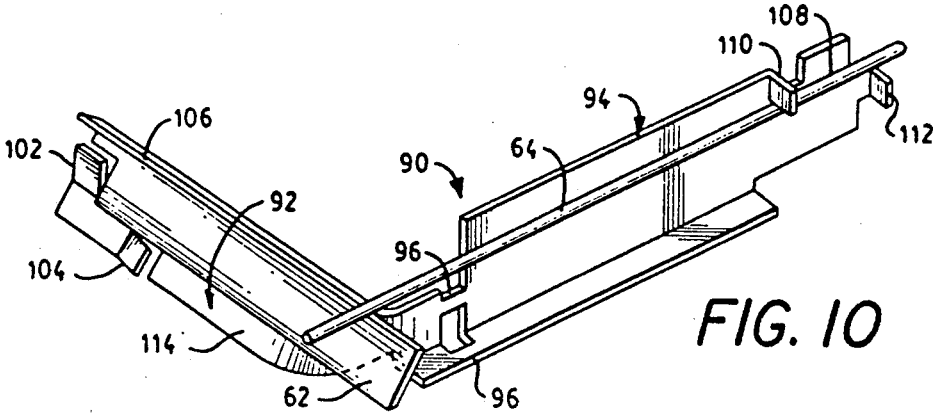
FIG. 10 is a perspective view of the second embodiment of the thermal switch assembly prior to installation in the lamp.

An embodiment of the thermal switch assembly which insures proper positioning of the bimetal element 62 relative to the conductor 64 is shown in FIGS. 8–10. A mounting frame 90 includes a first frame part 92 joined to a second frame part 94 by one or more removable frame parts 96. The first and second frame parts 92 and 94 each comprise a generally flat metal strip. The first frame part 92 is oriented at approximately 90° with respect to the second frame part 94. The bimetal element 62 is attached to first frame part 92, preferably by welding, at or near end 100 of bimetal element 62. Raised tabs 102 and 104 and raised edge 106 insure proper positioning of bimetal element 62 on first frame part 92. The conductor 64 is attached to second frame part 94, preferably by welding, at or near end 108 of conductor 64. Raised tabs 110 and 112 insure proper positioning of conductor 64 on second frame part 94. A mounting surface 114 of first frame part 92 is oriented at an angle in the range of 45° to 75°, with respect to longitudinal axis of conductor 64.

The thermal switch assembly, including bimetal element 62, conductor 64 and mounting frame 90, is shown prior to installation in FIG. 10. The first and second frame parts 92 and 94 are held in fixed positions relative to each other by removable tabs 96. The entire mounting frame 90 can be fabricated from a single piece of sheet metal. The thermal switch assembly is mounted in a lamp as shown in FIGS. 8 and 9 with first frame part 92 welded to starting electrode lead 36. The second frame part 94 is welded to electrode lead 34 and to lower frame member 44. Then tabs 96 are removed. Since the first and second frame parts 92 and 94 are securely mounted to electrode leads 34 and 36 and to lower frame member 44, the bimetal element 62 and conductor 64 remain in fixed positions relative to each other.

In operation, the bimetal element 62 deforms to position 62*a* as shown in phantom in FIG. 8, in which it contacts conductor 64 at the predetermined closure temperature. As the temperature increases above the closure temperature, the bimetal element deforms to position 62*b* as shown in phantom in FIG. 8, and the conductor 64 is slightly deformed as shown in phantom at 64*b* in FIG. 8. After installation, the thermal switch assembly shown in FIGS. 8–10 operates in the same manner as the frame 90 has the additional advantage that the nickel ribbon 54 shown in FIG. 2 can be eliminated because the second frame part 94 is welded to electrode 34 and lower frame member 44 to provide an electrical connection between these parts.

Each embodiment of the thermal switch assembly described herein operates with very little stress in the bimetal element and the conductor 64. In prior art thermal switches, the bimetal element is stressed at elevated temperatures. When the switch components are repeatedly stressed over the life of the lamp, the switch components become permanently deformed and do not return to their original shapes at room temperature. This causes the switching operation to occur at a different temperature, and in some cases, switching operation fails entirely. In addition, the thermal switching assembly of the present invention provides self cleaning contacts because the edge of the bimetal strip 62 slides along the conductor 64 as the temperature increases above the closure temperature at which contact first occurs. Thus, the area of contact between bimetal element 62 and conductor 64 is scraped clean each time the lamp is turned on or off.

The thermal switch assembly of the present invention has been described in connection with controlling operation of a starting electrode in an arc discharge lamp. However, the thermal switch assembly of the present invention is not limited to use in arc discharge lamps. Thermal switches are utilized in a variety of lamps for controlling application of electrical energy to various light-emitting devices. The thermal switch assembly of the present invention can be utilized in any electric lamp requiring a thermal switch.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

a light-transmissive lamp envelope;

an arc tube mounted within said lamp envelope said arc tube including first and second main electrodes and a starting electrode;

means for conducting electrical energy to said main electrodes; and a thermal switch assembly for controlling application of a voltage between said first main electrode and said starting electrode during starting of said lamp, said thermal switch assembly including, a bimetal element having a fixed portion and a movable portion, said movable portion being movable in a plane in response to temperature variations, said bimetal element having a longitudinal axis, said bimetal element comprising an elongated bimetal strip having an edge that contacts said conductor at said closure temperature, and a resilient, elongated conductor having a longitudinal axis and being fixed at or near one end, said bimetal element and said conductor being mounted within said lamp envelope such that a first angle between the longitudinal axis of said conductor and the plane of movement of said bimetal element has a nonzero value and a second angle between the longitudinal axis of said conductor and the longitudinal axis of said bimetal element has a nonzero value, said bimetal element contacts said conductor at a predetermined closure temperature, and said conductor is deformed by said bimetal element at temperatures greater than said closure temperature thereby substantially eliminating stress on said bimetal element such that no permanent deformation of said bimetal element occurs.

2. An arc discharge lamp as defined in claim 1 wherein said conductor comprises a tungsten wire.

3. An arc discharge lamp as defined in claim 1 wherein said first angle is in the range of up to about 45°.

4. An arc discharge lamp as defined in claim 1 wherein said second angle is about 90°.

5. An arc discharge lamp as defined in claim 1 wherein only the edge of said bimetal strip contacts said conductor.

6. An arc discharge lamp as defined in claim 1 wherein said first angle is in a range of about 30° to 45°.

7. An arc discharge lamp as defined in claim 1 wherein said bimetal element is affixed to an electrical lead of said starting electrode and said conductor is affixed to a frame member that is electrically connected to an electrical lead of said first main electrode.

8. An arc discharge lamp as defined in claim 7 wherein said conductor is retained in a holder attached to said frame member.

9. An arc discharge lamp as defined in claim 1 wherein said bimetal element and said conductor are each substantially straight at room temperature.

10. An arc discharge lamp as defined in claim 1 wherein said thermal switch assembly further includes a mounting frame including a first frame part attached to a first conductive member in said lamp and a second frame part attached to a second conductive member in said lamp, said first and second frame parts of said mounting frame being joined by a removable frame part until installation in said arc discharge lamp, said bimetal element being affixed to said first frame part and said conductor being affixed to said second frame part such that said mounting frame providing a desired positioning of said conductor relative to said bimetal element.

11. An arc discharge lamp as defined in claim 12 wherein said first frame part is attached to an electrical lead of said starting electrode and said second frame part is attached to an electrical lead of said first main electrode.

12. An arc discharge lamp as defined in claim 1 wherein a point of contact between said bimetal element and said conductor moves with a sliding action along said conductor as the temperature of said bimetal element increases above said closure temperature.

13. An electric lamp comprising:

a light-transmissive lamp envelope;

a light-emitting device mounted within said lamp envelope;

means for conducting electrical energy to said light-emitting device; and a thermal switch assembly mounted within said lamp envelope for controlling application of electrical energy to said light-emitting device, said thermal switch assembly including, a bimetal element having a fixed portion and a movable portion, said movable portion being movable in a plane in response to temperature variations, said bimetal element having a longitudinal axis, said bimetal element comprising an elongated bimetal strip having an edge that contacts said conductor at said closure temperature, and a resilient, elongated conductor having a longitudinal axis and being fixed at or near one end, said bimetal element and said conductor being mounted within said lamp envelope such that a first angle between the longitudinal axis of said conductor and the plane of movement of said bimetal element has a nonzero value and a second angle between the longitudinal axis of said conductor and the longitudinal axis of said bimetal element has a nonzero value, said bimetal element contacts said conductor at a predetermined closure temperature, and said conductor is deformed by said bimetal element at temperatures greater than said closure temperature thereby substantially eliminating stress on said bimetal element such that no permanent deformation of said bimetal element occurs.

14. An electric lamp as defined in claim 13 wherein said conductor comprises a tungsten wire.

15. An electric lamp as defined in claim 13 wherein said first angle is in the range of up to about 45°.

16. An electric lamp as defined in claim 13 wherein said second angle is about 90°.

17. An electric lamp as defined in claim 13 wherein only the edge of said bimetal strip contacts said conductor.

18. An electric lamp as defined in claim 13 wherein said thermal switch assembly further includes a mounting frame including a first frame part attached to a first conductive member in said lamp and a second frame part attached to a second conductive member in said lamp, said first and second frame parts of said mounting frame being joined by a removable frame part until installation in said electric lamp, said bimetal element being affixed to said first frame part and said conductor being affixed to said second frame part such that said mounting frame providing a desired positioning of said conductor relative to said bimetal element.

19. An electric lamp as defined in claim 13 wherein a point of contact between said bimetal element and said conductor moves with a sliding action along said conductor as the temperature of said bimetal element increases above said closure temperature.

20. An thermal switch assembly comprising:

a mounting frame including a first frame part and a second frame part that are jointed by a removable frame part;

a bimetal element attached to said first frame part, said bimetal element comprising an elongated bimetal strip having an edge that contacts said conductor at said closure temperature; and a conductor attached to said second frame part, said mounting frame providing a desired positioning of said conductor relative to said bimetal element such that said bimetal element contacts said conductor at a predetermined closure temperature and said conductor is deformed by said bimetal element at temperatures greater than said closure temperature thereby substantially eliminating stress on said bimetal element such that no permanent deformation of said bimetal element occurs, the removable frame part of said mounting frame being removed after said first frame part is affixed to a first conductive member and said second frame part is affixed to a second conductive member.

21. A thermal switch assembly as defined in claim 20 wherein said conductor comprises a tungsten wire.

22. A thermal switch assembly as defined in claim 20 wherein only the edge of said bimetal strip contacts said conductor.

23. A thermal switch assembly as defined in claim 20 wherein said removable frame part comprises one or more removable tabs.

24. A thermal switch assembly as defined in claim 20 wherein a point of contact between said bimetal element and said conductor moves with a sliding action along said conductor as the temperature of said bimetal element increases above said closure temperature.

* * * * *